US008754903B2

(12) United States Patent
Kim et al.

(10) Patent No.: US 8,754,903 B2
(45) Date of Patent: Jun. 17, 2014

(54) FLAT PANEL DISPLAY AND METHOD OF DRIVING THE SAME

(75) Inventors: Gun-Shik Kim, Yongin (KR); Jae-Shin Kim, Yongin (KR); Jun-Sik Oh, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 833 days.

(21) Appl. No.: 12/384,906

(22) Filed: Apr. 10, 2009

(65) Prior Publication Data

US 2009/0267962 A1 Oct. 29, 2009

(30) Foreign Application Priority Data

Apr. 29, 2008 (KR) ..... 10-2008-0039848

(51) Int. Cl.
*G09G 5/02* (2006.01)

(52) U.S. Cl.
USPC ..... 345/596; 345/690

(58) Field of Classification Search
USPC ..... 345/596, 690
See application file for complete search history.

(56) References Cited

U.S. PATENT DOCUMENTS

| | | | | |
|---|---|---|---|---|
| 5,714,974 | A | 2/1998 | Liu | |
| 6,008,794 | A | 12/1999 | Ishii | |
| 6,040,812 | A * | 3/2000 | Lewis | 345/89 |
| 6,069,609 | A * | 5/2000 | Ishida et al. | 345/596 |
| 2005/0140584 | A1 * | 6/2005 | Kim et al. | 345/60 |
| 2007/0070018 | A1 | 3/2007 | Moon | |
| 2008/0031530 | A1 | 2/2008 | Kim et al. | |

FOREIGN PATENT DOCUMENTS

| | | | |
|---|---|---|---|
| EP | 0656616 | A1 | 6/1995 |
| EP | 1136974 | A1 | 9/2001 |
| EP | 1594113 | A2 | 11/2005 |
| EP | 1 619 652 | A2 | 1/2006 |
| EP | 1630776 | A2 | 3/2006 |
| EP | 0 994 457 | B1 | 9/2007 |
| JP | 06-324656 | | 11/1994 |
| JP | 2000-148068 | | 5/2000 |
| JP | 2000-231362 | | 8/2000 |
| JP | 2003-330420 (A) | | 11/2003 |
| JP | 2004-184660 | A | 7/2004 |
| JP | 2005-128207 | | 5/2005 |
| JP | 2006-039039 | A | 2/2006 |
| JP | 2006-215534 | A | 8/2006 |
| JP | 2007-94411 | A | 4/2007 |
| KR | 10-0512105 (B1) | | 8/2005 |
| KR | 10-0552908 (B1) | | 2/2006 |
| KR | 10-0570968 (B1) | | 4/2006 |
| WO | WO 2005/001807 | A2 | 1/2005 |

OTHER PUBLICATIONS

Office Action corresponding to European Application No. 09251214.4 dated Feb. 3, 2010.

(Continued)

*Primary Examiner* — Maurice L McDowell, Jr.
(74) *Attorney, Agent, or Firm* — Knobbe, Martens, Olson & Bear LLP

(57) ABSTRACT

A flat panel display, which can save manufacturing costs and allow various types of dither masks to be applied, and a driving method thereof are disclosed. The flat panel display includes a look-up table (LUT) storing one dither mask, which is used to algorithmically generate additional dither masks. The dither masks are applied to image data to improve image quality.

8 Claims, 5 Drawing Sheets

(56) References Cited

OTHER PUBLICATIONS

Japanese Office Action dated Jun. 28, 2011 for Japanese Patent Application No. JP 2008-257326 which shares priority of Korean Patent Application No. KR 10-2008-0039848 with captioned U.S. Appl. No. 12/384,906.

European Examination Report dated May 3, 2012 for European Patent Application No. EP 09 251 214.4 which shares priority of Korean Patent Application No. KR 10-2008-0039848 with captioned U.S. Appl. No. 12/384,906.

Japanese Office Action dated Jun. 12, 2012 for Japanese Patent Application No. JP 2008-257326 which shares priority of Korean Patent Application No. KR 10-2008-0039848 with captioned U.S. Appl. No. 12/384,906.

Korean Office Action dated Aug. 24, 2009 for Korean Patent Application No. KR 10-2008-0039848 which corresponds to captioned U.S. Appl. No. 12/384,906.

European Summons dated Apr. 8, 2014 for European Patent Application No. EP 09 251 214.4 which shares priority of Korean Patent Application No. KR 10-2008-0039848 with captioned U.S. Appl. No. 12/384,906.

* cited by examiner

FIG. 3

| | | | | | | | |
|---|---|---|---|---|---|---|---|
| 11 | 43 | 16 | 48 | 3 | 35 | 7 | 39 |
| 59 | 27 | 64 | 32 | 51 | 19 | 55 | 23 |
| 5 | 37 | 6 | 38 | 10 | 42 | 12 | 44 |
| 53 | 21 | 54 | 22 | 58 | 26 | 60 | 28 |
| 15 | 47 | 2 | 34 | 14 | 46 | 4 | 36 |
| 63 | 31 | 50 | 18 | 62 | 30 | 52 | 20 |
| 1 | 33 | 9 | 41 | 8 | 40 | 13 | 45 |
| 49 | 17 | 57 | 25 | 56 | 24 | 61 | 29 |

FIG. 4

| | | | | | | | |
|---|---|---|---|---|---|---|---|
| 54 | 22 | 49 | 17 | 62 | 30 | 58 | 26 |
| 6 | 38 | 1 | 33 | 14 | 46 | 10 | 42 |
| 60 | 28 | 59 | 27 | 55 | 23 | 53 | 21 |
| 12 | 44 | 11 | 43 | 7 | 39 | 5 | 37 |
| 50 | 18 | 63 | 31 | 51 | 19 | 61 | 29 |
| 2 | 34 | 15 | 47 | 3 | 35 | 13 | 45 |
| 64 | 32 | 56 | 24 | 57 | 25 | 52 | 20 |
| 16 | 48 | 8 | 40 | 9 | 41 | 4 | 36 |

FIG. 5

| | | | | | | | |
|---|---|---|---|---|---|---|---|
| 11 | 59 | 5 | 53 | 15 | 63 | 1 | 49 |
| 43 | 27 | 37 | 21 | 47 | 31 | 33 | 17 |
| 16 | 64 | 6 | 54 | 2 | 50 | 9 | 57 |
| 48 | 32 | 38 | 22 | 34 | 18 | 41 | 25 |
| 3 | 51 | 10 | 58 | 14 | 62 | 8 | 56 |
| 35 | 19 | 42 | 26 | 46 | 30 | 40 | 24 |
| 7 | 55 | 12 | 60 | 4 | 52 | 13 | 61 |
| 39 | 23 | 44 | 28 | 36 | 20 | 45 | 29 |

FIG. 6

| | | | | | | | |
|---|---|---|---|---|---|---|---|
| 29 | 45 | 20 | 36 | 28 | 44 | 23 | 39 |
| 61 | 13 | 52 | 4 | 60 | 12 | 55 | 7 |
| 24 | 40 | 30 | 46 | 26 | 42 | 19 | 35 |
| 56 | 8 | 62 | 14 | 58 | 10 | 51 | 3 |
| 25 | 41 | 18 | 34 | 22 | 38 | 32 | 48 |
| 57 | 9 | 50 | 2 | 54 | 6 | 64 | 16 |
| 17 | 33 | 31 | 47 | 21 | 37 | 27 | 43 |
| 49 | 1 | 63 | 15 | 53 | 5 | 59 | 11 |

FIG. 7

| | | | | | | | |
|---|---|---|---|---|---|---|---|
| 49 | 17 | 57 | 25 | 56 | 24 | 61 | 29 |
| 1 | 33 | 9 | 41 | 8 | 40 | 13 | 45 |
| 63 | 31 | 50 | 18 | 62 | 30 | 52 | 20 |
| 15 | 47 | 2 | 34 | 14 | 46 | 4 | 36 |
| 53 | 21 | 54 | 22 | 58 | 26 | 60 | 28 |
| 5 | 37 | 6 | 38 | 10 | 42 | 12 | 44 |
| 59 | 27 | 64 | 32 | 51 | 19 | 55 | 23 |
| 11 | 43 | 16 | 48 | 3 | 35 | 7 | 39 |

FIG. 8

| | | | | | | | |
|---|---|---|---|---|---|---|---|
| 39 | 7 | 35 | 3 | 48 | 16 | 43 | 11 |
| 23 | 55 | 19 | 51 | 32 | 64 | 27 | 59 |
| 44 | 12 | 42 | 10 | 38 | 6 | 37 | 5 |
| 28 | 60 | 26 | 58 | 22 | 54 | 21 | 53 |
| 36 | 4 | 46 | 14 | 34 | 2 | 47 | 15 |
| 20 | 52 | 30 | 62 | 18 | 50 | 31 | 63 |
| 45 | 13 | 40 | 8 | 41 | 9 | 33 | 1 |
| 29 | 61 | 24 | 56 | 25 | 57 | 17 | 49 |

FLAT PANEL DISPLAY AND METHOD OF DRIVING THE SAME

CROSS-REFERENCE TO RELATED APPLICATIONS

This application claims priority to and the benefit of Korean Patent Application No. 10-2008-0039848, filed on Apr. 29, 2008, in the Korean Intellectual Property Office, the entire content of which is incorporated herein by reference.

BACKGROUND

1. Field

The field relates to a flat panel display and a method of driving the same, and more particularly, to a flat panel display, which can save manufacturing costs and allow various types of dither masks to be applied, and a driving method thereof.

2. Description of the Related Technology

Recently, there have been various types of flat panel display devices of reduced weight and volume when compared with cathode ray tubes. The flat panel display devices may take the form of a liquid crystal display, a field emission display, a plasma display panel, an organic light emitting display device, and the like.

Among these flat panel display devices, the organic light emitting display device displays images using an organic light emitting diode (OLED) that emits light as a result of the recombination of electrons and holes. The organic light emitting display device has a fast response speed and is driven with low power consumption.

Generally, pixels of an organic light emitting display device display images by charging a predetermined voltage into a storage capacitor Cst included in each of the pixels and by supplying a current corresponding to the charged voltage to an OLED This is called an analog driving method. However, in such a method, there is a limit of gray-level expression because the number of gray levels expressed is related to the precision of the voltage stored in the storage capacitor Cst. Furthermore, it is difficult to display a uniform image due to the threshold voltage and mobility variation of the driving transistors included in each of the pixels.

SUMMARY OF CERTAIN INVENTIVE ASPECTS

One aspect is a flat panel display, which includes a look-up table (LUT) storing a dither mask, and a dithering unit configured to produce at least one additional dither mask based on the dither mask stored in the LUT, and to apply different dither masks to image data during each successive frame period to generate dithered data, where the number of perceived gray levels of the dithered data is greater than the number of perceived gray levels of the image data. The display also includes a sub-frame mapping unit configured to map the dithered data to a plurality of sub-frame data patterns included in one frame and to output the mapped data.

Another aspect is a method of driving a flat panel display. The method includes storing a dither mask in a look up table (LUT), producing at least one additional dither mask using the stored dither mask, dithering data using different dither masks during every frame period, mapping the dithered data to a plurality of sub-frame patterns included in one frame, and generating data signals using the mapped data.

Another aspect is a flat panel display. The display includes a look-up table (LUT) storing no more than one dither mask, a dithering unit configured to produce additional dither masks based on the stored dither mask, and to apply the additional dither masks to image data to generate dithered data, where the number of perceived gray levels of the dithered data is greater than the number of perceived gray levels of the image data. The display also includes a sub-frame mapping unit configured to map the dithered data to a plurality of sub-frame data patterns included in one frame and to output the mapped data.

BRIEF DESCRIPTION OF THE DRAWINGS

The accompanying drawings, together with the specification, illustrate exemplary embodiments of the present invention, and, together with the description, serve to explain the principles of the present invention.

FIG. 3 is a view illustrating a dither mask stored in a look-up table (LUT) shown in FIG. 1.

FIGS. 4 to 8 are views illustrating additional dither masks produced by the dither mask shown in FIG. 3:

DETAILED DESCRIPTION OF CERTAIN INVENTIVE EMBODIMENTS

Figure 1:
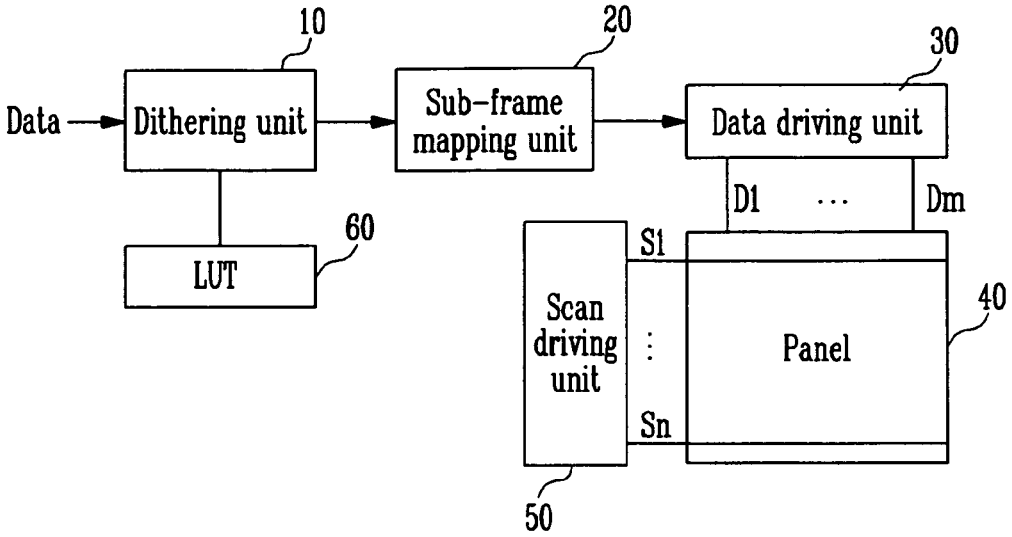
FIG. 1 is a block diagram illustrating a flat panel display according to an embodiment.

In order to solve problems discussed in the background section, a digital driving method has been proposed. In the digital driving method, a data signal corresponding to turn-on or turn-off is supplied to each pixel, and turn-on times of the pixels are controlled during a plurality of sub-frame periods included in each frame. To express the various gray levels, the time for each pixel to be turned on is controlled.

However, in the digital driving method, gray-level expression is limited by the number of sub-frames included in one frame. In order to solve such a problem, a method of increasing gray levels using one or more dither masks is used.

A dither mask is used to increase gray levels and improve false contour noises by additionally selecting light emitting and non-light emitting pixels regardless of input data. Here, if gray levels are increased using one dither mask, a regular pattern (dither noises) may be generated by the dither mask and viewed by the user. In order to solve such a problem, a plurality of dither masks should be alternately used during each successive frame. However, if a plurality of dither masks are included in an organic light emitting display device, the memory needed for the system is increased, and accordingly manufacturing costs are increased.

Hereinafter, certain exemplary embodiments will be described with reference to the accompanying drawings. When a first element is described as being coupled to a second element, the first element may be not only directly coupled to the second element but may also be indirectly coupled to the second element via a third element. Further, some of the elements that are not essential to the complete understanding of the invention are omitted. Also, like reference numerals generally refer to like elements throughout.

FIG. 1 is a block diagram illustrating a flat panel display according to an embodiment. Referring to FIG. 1, the flat panel display includes a dithering unit 10, a sub-frame mapping unit 20, a data driving unit 30, a scan driving unit 50, a panel 40 and a look-up table 60 (hereinafter, referred to as an "LUT").

One dither mask is stored in the LUT 60. Because one dither mask is stored in the LUT 60, memory requirements are reduced and manufacturing costs are saved accordingly.

The dithering unit 10 receives data. The dithering unit 10 performs dithering using a dither mask, thereby increasing gray levels, as discussed above. For example, the dithering unit 10 additionally selects pixels to be turned on and/or off during a sub-frame period. Because perceived gray levels are increased by the dithering unit 10, false contour noises are improved.

The dithering unit 10 additionally produces one or more dither masks using the one dither mask stored in the LUT 60. The dithering unit 10 applies different dither masks at each successive frame period, so that dithering noises are minimized. The detailed configuration of the dithering unit 10 will be described later.

The sub-frame mapping unit 20 maps the data supplied from the dithering unit 10 to sub-frame data patterns and then outputs the mapped data.

The data driving unit 30 latches the data for each bit from the sub-frame mapping unit 20, and then supplies the latched data as data signals to data lines D1 to Dm of the panel 40 during every horizontal period.

The scan driving unit 50 sequentially supplies a scan signal to scan lines S1 to Sn at every horizontal period of the sub-frame period. Then, pixels (not shown) are sequentially selected for each horizontal line, and data signals are supplied to the selected pixels.

The panel 40 includes pixels respectively disposed near intersection points of the data lines D1 to Dm and the scan lines S1 to Sn. The pixels display an image by emitting light or not emitting light during the sub-frame period, according to the data signals.

Figure 2:
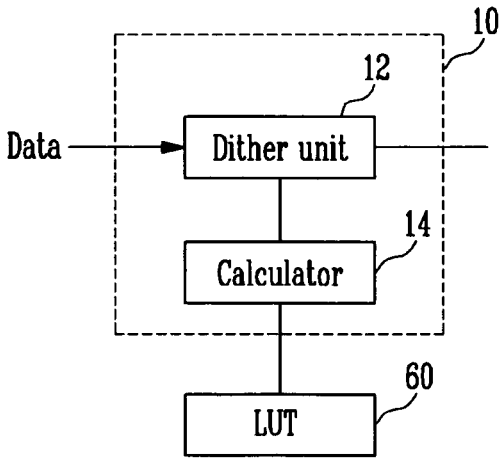
FIG. 2 is a block diagram illustrating an embodiment of a dithering unit shown in FIG. 1.

FIG. 2 is a block diagram illustrating an embodiment of the dithering unit 10 shown in FIG. 1.

Referring to FIG. 2, the embodiment of dithering unit 10 includes a dither unit 12 and a calculator 14.

The dither unit 12 additionally selects pixels to be turned on and/or off using a dither mask provided from the calculator 14.

The calculator 14 supplies different dither masks to the dither unit 12 during each successive frame period. To this end, the calculator 14 additionally produces at least one dither mask using the dither mask stored in the LUT 60. Then, the dither masks produced by the calculator 14 and the dither mask stored in the LUT 60 are supplied to the dither unit 12 so that different dither masks can be applied during each successive frame period.

An operation of the calculator 14 will be described in additional detail. A dither mask shown in FIG. 3 is first stored in the LUT 60. Here, the dither mask stored in the LUT 60 is determined so that gray levels can be stably increased. Practically, various types of dither masks known in the art may be stored in the LUT 60.

The calculator 14 produces an additional dither mask using the dither mask stored in the LUT 60. For example, the calculator 14 produces an additional dither mask using "k" expressed by the following Expression 1.

$$i \times j + 1 = k \quad (1)$$

In the Expression 1, "i" denotes the number of columns of the dither mask stored in the LUT 60, and "j" denotes the number of rows of the dither mask stored in the LUT 60. Since each of the "i" and "j" is 8 in the embodiment shown in FIG. 3, "k" is 65. The calculator 14 that has calculated the value of "k" produces a new dither mask shown in FIG. 4 by subtracting "k" from all numbers included in the dither mask stored in the LUT 60.

As shown in FIGS. 5 and 6, the calculator 14 may produce a new dither mask by exchanging numbers symmetric about one or more diagonal lines of the dither mask stored in the LUT 60.

As shown in FIGS. 7 and 8, the calculator 14 may produce a new dither mask by exchange numbers symmetric about a lateral center axis and/or a longitudinal center axis of the dither mask stored in the LUT 60. That is, the calculator 14 of the present invention may produce at least one new dither mask using one dither mask stored in the LUT 60.

The dither unit 12 increases gray levels by applying different dither masks during each successive frame period. For example, the dither unit 12 can increase gray levels by alternately applying the six dither masks shown in FIGS. 3 to 8 during each successive frame period.

Figure 9:
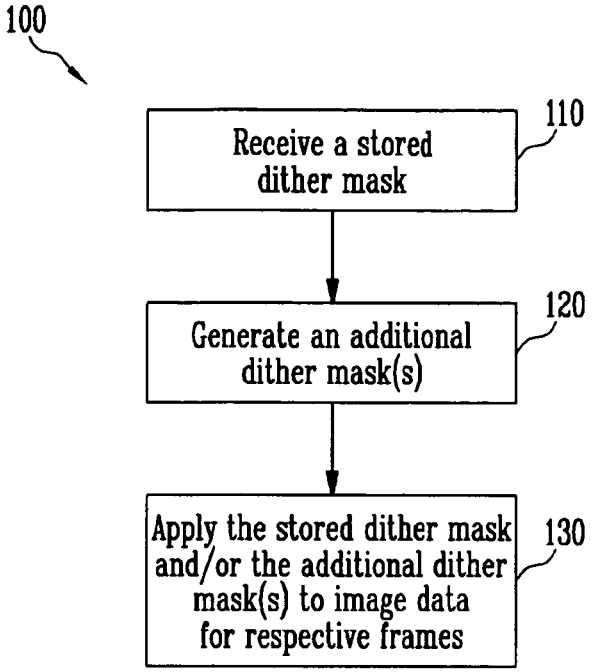
FIG. 9 is a flowchart showing an embodiment of a method.

FIG. 9 is a flowchart showing an embodiment of a method 100 used by a display to generate and apply dither masks to image data. At step 110 a dithering unit, such as dithering unit 10 of FIG. 1 receives data of a dither mask. In some embodiments, the dither mask is received from another source.

In step 120, an additional dither mask is generated using the received dither mask. In some embodiments, the additional dither mask is generated by performing an algorithmic operation on the data of the received dither mask. For example, the same data as the received dither mask may be used, where the individual data of the additional dither mask have a different arrangement as that in the received dither mask. For example, the calculator 14 discussed above exchanges data symmetrically about an axis of the dither masks. In some embodiments, the additional dither mask is generated by addition of a constant and performing a modulus operation to each of the data of the received dither mask. Various other operations may be performed to generate additional dither masks.

In step 130 at least two different dither masks are applied to image data to achieve the desired dithering results. In some embodiments, applying the dither masks to image data includes mapping the dithered data to a plurality of sub-frame patterns of a frame, and may also include generating data signals using the mapped data. A first dither mask may be applied to every even number frame, and a second dither mask may be applied to every odd number frame. Additional dither masks and additional arrangements are also beneficial. In some embodiments, the received dither mask is used, while in other embodiments the received dither mask is not used, and two or more additional dither masks are used. In some embodiments, one or more additional dither masks are applied to the image data substantially as the additional dither masks are generated. Accordingly, in some embodiments, only a portion of the additional dither mask or none of the additional dither mask is stored in a memory. In such embodiments, the data of the additional dither mask is lost once it is used. This reduces the memory requirements for the hardware implementing the method 100.

While the present invention has been described in connection with certain exemplary embodiments, it is to be understood that the invention is not limited to the disclosed embodiments, but, on the contrary, is intended to cover various modifications and equivalent arrangements.

What is claimed is:

1. A flat panel display, comprising:

a look-up table (LUT) storing a dither mask;

a dithering unit configured to produce a plurality of dither masks based on the dither mask stored in the LUT, and to apply different ones of the dither masks to image data during each successive frame period to generate dithered data, wherein the number of perceived gray levels of the dithered data is greater than the number of perceived gray levels of the image data; and a sub-frame mapping unit configured to map the dithered data to a plurality of sub-frame data patterns included in one frame and to output the mapped data, wherein the dithering unit comprises:

a calculator configured to produce dither masks; and a dither unit configured to generate the dithered data, wherein the calculator produced the dither masks by subtracting a number from all numbers including in the stored dither masks.

2. The flat panel display as claimed in claim 1, further comprising:

a data driving unit configured to receive the mapped data, to generate data signals using the mapped data, and to supply generated data signals to data lines of the display;

a scan driving unit configured to supply scan signals to scan lines; and a plurality of pixels respectively disposed near intersection points of the data lines and the scan lines, and to emit light or to not emitting light during every sub-frame period according to the data signals.

3. The flat panel display as claimed in claim 1, wherein the number is produced by adding 1 to the value obtained by multiplying the quantity of rows and the quantity of columns of the stored dither mask.

4. A flat panel display, comprising:

a look up table (LUT) storing a dither mask;

a dithering unit configured to produce a plurality of dither masks based on the dither mask stored in the LUT, and to apply different ones of the dither masks to image data during each successive frame period to generate dithered data, wherein the number of perceived gray levels of the image data; and a sub-frame mapping in unit configured to map the dithered data to a plurality of sub-frame data patterns included in one frame and to output the mapped data, wherein the dithering unit comprises:

a calculator configured to produce the dither masks, and a dither unit configured to generate the dithered data, wherein the calculator produces the dither masks by exchanging numbers symmetrically about a lateral center axis or longitudinal center axis of the stored dither mask.

5. A method of driving a flat panel display, the method comprising:

producing a plurality of dither masks based on a stored dither mask;

dithering data using different dither masks during each of a plurality of frame periods;

mapping the dithered data to a plurality of sub-frame patterns included in one frame;

generating data signals using the mapped data; and driving the flat panel display with the data signals, wherein the producing the dither masks is performed by subtracting a number from all numbers in the stored dither mask.

6. The method as claimed in claim 5, wherein producing the dither masks comprises performing an algorithmic operation on the stored dither mask.

7. The method as claimed in claim 5, wherein the number is produced by adding 1 to a value obtained by multiplying the quantity of rows and the quantity of columns of the stored dither mask.

8. A flat panel display, comprising:

a look up table (LUT) storing a dither mask;

a dithering unit configured to produce a plurality of dither masks based on the dither mask stored in the LUT, and to apply different ones of the dither masks to image data during each successive frame period to generate dithered data, wherein the number of perceived gray levels of the image data is greater than the number of perceived gray levels of the image data; and a sub-frame mapping unit configured to map the dithered data to a plurality of sub-frame data patterns included in one frame and to output the mapped data, wherein the dithering unit comprises:

a calculator configured to produce the dither masks;

a dither unit configured to generate the dithered data, and wherein the producing the dither masks is performed by exchanging numbers symmetric about a lateral center axis or longitudinal center axis of the stored dither mask.

* * * * *

UNITED STATES PATENT AND TRADEMARK OFFICE

CERTIFICATE OF CORRECTION

PATENT NO. : 8,754,903 B2
APPLICATION NO. : 12/384906
DATED : June 17, 2014
INVENTOR(S) : Gun-Shik Kim It is certified that error appears in the above-identified patent and that said Letters Patent is hereby corrected as shown below:

In the Specification

In column 2 at line 22, Change “FIG. 3:” to --FIG. 3.--.

In the Claims

In column 5 at line 37, In Claim 4, after “mapping” delete “in”.

Signed and Sealed this
Twenty-seventh Day of January, 2015

Michelle K. Lee

Michelle K. Lee
*Deputy Director of the United States Patent and Trademark Office*